US011239610B2

(12) United States Patent
Edenhofer et al.

(10) Patent No.: US 11,239,610 B2
(45) Date of Patent: Feb. 1, 2022

(54) ELECTRICAL PLUG WITH SPECIFIC EARTHING OF OUTER PARTS

(71) Applicant: TE Connectivity Industrial GmbH, Niederwinkling (DE)

(72) Inventors: Herbert Edenhofer, Schwarzach (DE); Philipp Moncher, Perasdorf (DE); Josef Achatz, Lalling (DE)

(73) Assignee: TE Connectivity Industrial GmbH, Niederwinkling (DE)

( * ) Notice: Subject to any disclaimer, the term of this patent is extended or adjusted under 35 U.S.C. 154(b) by 38 days.

(21) Appl. No.: 16/564,576

(22) Filed: Sep. 9, 2019

(65) Prior Publication Data

US 2019/0393652 A1 Dec. 26, 2019

Related U.S. Application Data

(63) Continuation of application No. PCT/EP2018/055848, filed on Mar. 8, 2018.

(30) Foreign Application Priority Data

Mar. 9, 2017 (DE) ..... 10 2017 104 982.7

(51) Int. Cl.
*H01R 13/652* (2006.01)
*H01R 13/508* (2006.01)

(52) U.S. Cl.
CPC ..... *H01R 13/652* (2013.01); *H01R 13/508* (2013.01)

(58) Field of Classification Search
CPC ..... H01R 13/652; H01R 13/6597; H01R 13/6596; H01R 13/508
USPC ..... 439/95, 607.55, 607.18, 607.34, 607.27
See application file for complete search history.

(56) References Cited

U.S. PATENT DOCUMENTS 4,202,591 A * 5/1980 Borgstrom ..... H02B 13/075 439/185
5,151,033 A * 9/1992 Kawai ..... H01R 13/648 439/95
5,240,424 A * 8/1993 Honma ..... H01R 13/639 439/95

(Continued)

FOREIGN PATENT DOCUMENTS

CN 1223487 A 7/1999
CN 101228673 A 7/2008

(Continued)

OTHER PUBLICATIONS

Chinese First Office Action and English translation, dated Jun. 11, 2020, 24 pages.

(Continued)

*Primary Examiner* — Marcus E Harcum
(74) *Attorney, Agent, or Firm* — Barley Snyder

(57) ABSTRACT

An electrical plug includes a plug housing having a first outer housing part and a second outer housing part separate from the first outer housing part, an earthing contact disposed in the plug housing, and an earthing connection element separate from the earthing contact and disposed in the plug housing. The first outer housing part and the second outer housing part are each at least partly metallic. The earthing connection element is electrically connected to the earthing contact, the first outer housing part, and the second outer housing part.

20 Claims, 5 Drawing Sheets

(56) References Cited

U.S. PATENT DOCUMENTS

| | | | | | |
|---|---|---|---|---|---|
| 5,346,403 | A * | 9/1994 | Hyzin | H01R 13/6583 439/95 |
| 5,573,411 | A | 11/1996 | Bartosz et al. | |
| 5,975,955 | A * | 11/1999 | Bogiel | H01R 13/6597 439/607.56 |
| 6,439,899 | B1 * | 8/2002 | Muzslay | H01R 13/5216 439/108 |
| 7,510,408 | B2 * | 3/2009 | Tsurumi | H01R 13/506 439/92 |
| 7,537,466 | B2 * | 5/2009 | Bartholoma | H01R 13/652 439/95 |
| 9,819,099 | B2 * | 11/2017 | Finona | H01R 4/625 |
| 10,153,595 | B2 * | 12/2018 | Quero | H01R 13/652 |
| 2009/0305558 | A1 | 12/2009 | Scholler et al. | |
| 2016/0352050 | A1 * | 12/2016 | Hu | H01R 13/648 |

FOREIGN PATENT DOCUMENTS

| | | | |
|---|---|---|---|
| CN | 201303150 | Y * | 9/2009 |
| CN | 201303150 | Y | 9/2009 |
| DE | 202005000229 | U1 | 3/2005 |
| DE | 202015102170 | U1 | 6/2015 |
| DE | 10 2014 112 991 | A1 | 3/2016 |
| EP | 0924808 | A1 | 6/1999 |
| GB | 2209428 | A | 12/1987 |

OTHER PUBLICATIONS

Abstract of CN 201303150, dated Sep. 2, 2009,1 page.
Machine translation of Abstract of DE 10 2014 112 991, dated Mar. 10, 2016, 1 page.
PCT Notification, International Search Report and the Written Opinion of The International Searching Authority, dated May 22, 2018, Intl Appl No. PCT/EP2018/055848, 13 pages.
Machine translation of Astract of DE 20 2015 102 170, dated Jun. 25, 2015, 1 page.
Abstract of DE 20 2005 000 229, dated Mar. 31, 2005, 1 page.

* cited by examiner

ELECTRICAL PLUG WITH SPECIFIC EARTHING OF OUTER PARTS

CROSS-REFERENCE TO RELATED APPLICATIONS

This application is a continuation of PCT International Application No. PCT/EP 2018/055848, filed on Mar. 8, 2018, which claims priority under 35 U.S.C. § 119 to German Patent Application No. 102017104982.7, filed on Mar. 9, 2017.

FIELD OF THE INVENTION

The present invention relates to an electrical plug and, more particularly, to an electrical plug having a plug housing with a plurality of metallic housing outer parts.

BACKGROUND

Electrical plugs commonly have at least two end sides each for linking to further components. Such electrical plugs, also called plug-in connectors, can be linked to a separate assembly such as a motor housing. Electrical plugs are also known as angle plugs, as disclosed for example in German Patent Application No. 202015102170 U1 and German Patent Application No. 202005000229 U1.

Electrical plugs usually have several electrical contacts, such as contact pins, with which signals can be transmitted, in particular data signals and signals for energy transmission. Electrical plugs also have a grounding or earthing contact or a protective earthing conductor contact. Because outer housing parts are made of metal in known electrical plugs, these must be earthed.

Individual strands are crimped onto an earthing contact or a protective earthing conductor contact for earthing. In particular, electrical plugs which comprise several separate outer housing parts and, where applicable, additional outer parts, a more extensive configuration of the protective earthing conductor connections is required. This is very complex with the aforementioned configurations, as a result of which a greater degree of mounting effort is required, with associated higher costs.

In electrical plugs which have several outer housing parts, the earthing or grounding is carried out or arranged in one of the outer housing parts and the remaining parts are then earthed by respective metal connections. Electrical connections for this earthing can be formed by screw connections. These screws are, however, also critical structural elements because they have relatively bad electrical conductance values and can also corrode over time. Precisely in the case of configurations of electrical plugs with several separate outer housing parts which are made of die-cast zinc, the pressing force of the outer housing parts that are connected to one another reduces due to the flow characteristics of the zinc. Also as a result of this, the electrical transition resistance increases over time; in some cases, the requirements on the earthing connections can no longer be met and the electrical plug must be exchanged. As a result, the longevity of the electrical plug is adversely affected.

SUMMARY

An electrical plug includes a plug housing having a first outer housing part and a second outer housing part separate from the first outer housing part, an earthing contact disposed in the plug housing, and an earthing connection element separate from the earthing contact and disposed in the plug housing. The first outer housing part and the second outer housing part are each at least partly metallic. The earthing connection element is electrically connected to the earthing contact, the first outer housing part, and the second outer housing part.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
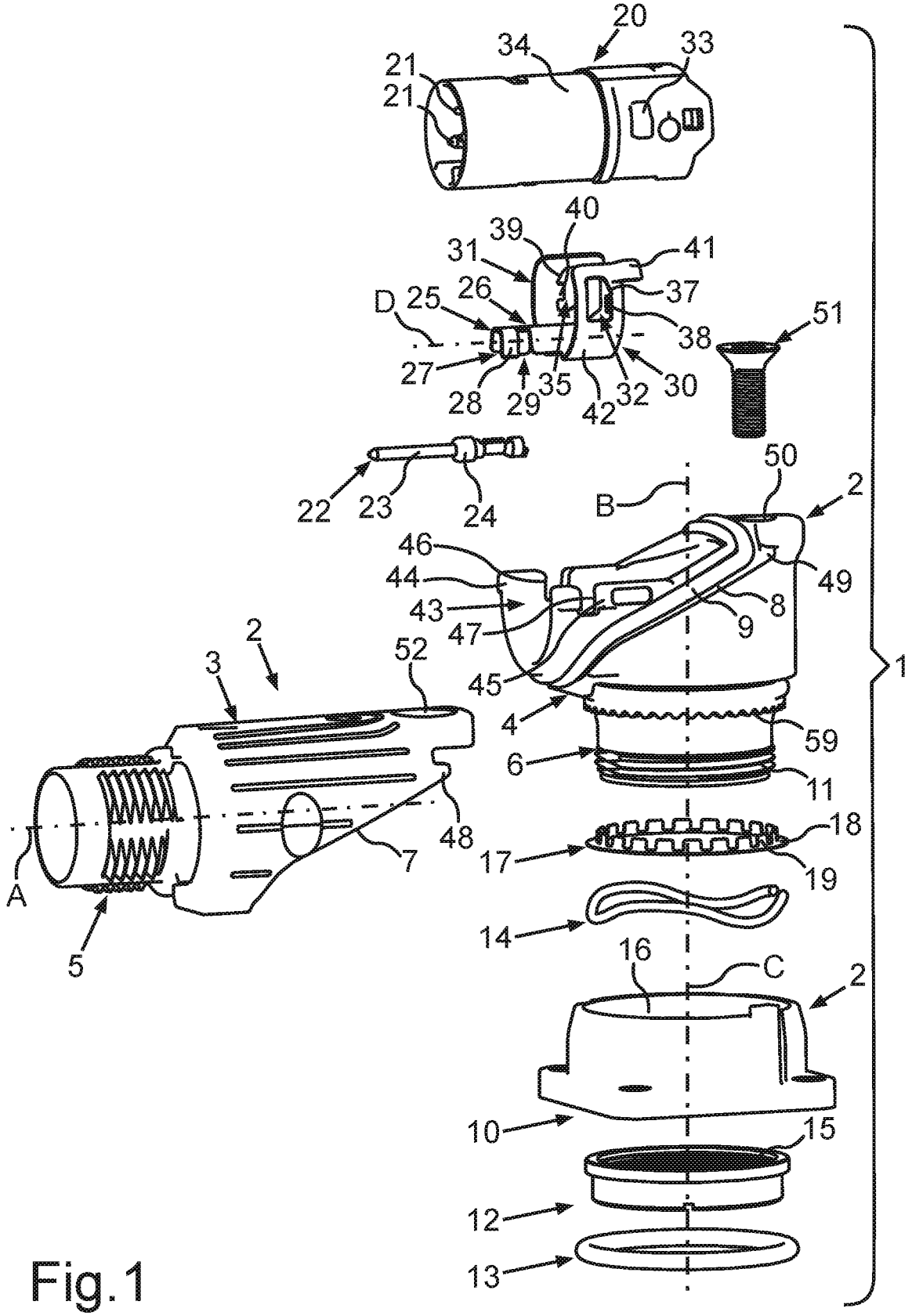
FIG. 1 is an exploded perspective view of an electrical plug according to an embodiment.
Figure 2:
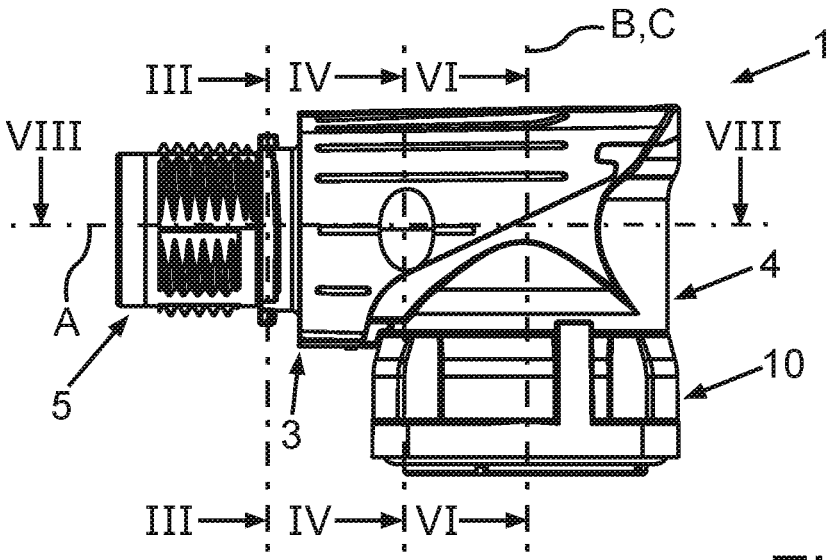
FIG. 2 is a side view of the electrical plug in an assembled state.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. The features and combinations of features specified herein and/or shown in the figures alone are not only useable in the respectively described combination, but rather are also useable in other combinations or in isolation, without departing from the framework of the invention. Thus, designs of the invention which are not explicitly shown and explained in the figures but which emerge and are able to be produced through separated combinations of features from the explained designs should be regarded as included and disclosed. Designs and combinations of features which thus do not have all features of an originally worded independent claim should also be regarded as disclosed.

The terms "above", "under", "in front", "to the rear" "horizontal", "vertical", "depth direction", "width direction", and "height direction" specify positions and orientations given by an observer standing in front and looking in the direction of the device while it is being used as intended and is arranged as intended.

An embodiment of an electrical plug 1, or plug-in connector, is shown in FIG. 1. In the embodiment shown in FIG. 1, the electrical plug 1 is an angle plug-in connector.

The electrical plug 1, as shown in FIG. 1, has a plug housing 2. In the shown embodiment, the plug housing 2 has a housing front part formed by a first outer housing part 3. The first outer housing part 3 is made of metal, and in the shown embodiment, is die-cast zinc. The plug housing 2 has a second outer housing part 4 which is separate from the first outer housing part 3. The second outer housing part 4 is likewise made of metal, such as die-cast zinc. The first outer housing part 3 has a longitudinal axis A, with a first joining region 5 at an end facing away from the second outer housing part 4, for joining to an assembly or an electrical line. The second outer housing part 4 has a longitudinal axis B, with a second joining region 6 at an end facing away from the first outer housing part 3. The outer housing parts 3, 4 are parts of the electrical plug 1 which are outwardly exposed and can be touched when the electrical plug is assembled.

As shown in FIG. 1, the two longitudinal axes A and B are oriented at an angle of between 60° and 120°, in an embodiment between 80° and 100°, and in a further embodiment at 90° to one another. In the mounted state, the first outer housing part 3 and the second outer housing part 4 are connected to one another and abut against one another; the first outer housing part has a first abutting edge 7 abutting against a second abutting edge 8 of the second outer housing part 4. A seal 9 is arranged between the first abutting edge 7 and the second abutting edge 8. The abutting edges 7 and 8 are each formed in oblique sectional planes relative to the longitudinal axes A and B and thus are formed in planes which are not oriented perpendicular to the longitudinal axes A and B.

The plug housing 2, as shown in FIG. 1, has a joining flange 10 which is made of metal and represents an outer part of the electrical plug 1. In an embodiment, the joining flange 10 is die-cast zinc. The joining flange 10 is separate from the two outer housing parts 3 and 4 and, in a mounted state, is connected to the second outer housing part 4. The joining flange 10 has a longitudinal axis C which is oriented coaxially relative to the longitudinal axis B. With the joining flange 10, the electrical plug 1 can be arranged on an assembly, for example on a motor housing.

In an embodiment, the joining flange 10 is screwed onto the second outer housing part 4. As shown in FIG. 1, a thread 11 is formed on the second joining region 6. A retaining nut 12 can be connected to the thread 11 by an inner thread 15 of the retaining nut 12 so that the joining flange 10 is then indirectly screwed onto the second outer housing part 4. An additional seal 13, which is an O-ring in an embodiment, can be provided as a sealed interface between the electrical plug 1 and the assembly.

As shown in FIG. 1, a zigzag spring 14 is provided which is formed as a ring section and pressed between the retaining nut 12 and a radial web on an inner side 16 of the joining flange 10 by the retaining nut 12.

As shown in FIG. 1, the electrical plug 1 has an electrical contact element 17 that, like the other specified structural elements, is also a separate component. The electrical contact element 17 is made of metal and formed as a contact ring which is toothed. The contact element 17 has a base ring 18 and a plurality of upwardly standing tabs or segments 19 which are formed on the base ring 18.

The electrical plug 1, as shown in FIG. 1, has a tubular insulating body 20 which is a separate component and, in an embodiment, is made of plastic. A plurality of pin-like contacts 21 are arranged in the tubular insulating body 20. These electrical contacts 21 are formed for the transmission of signals, in particular data signals and energy signals.

The electrical plug 1 has at least one pin-like earthing contact 22, as shown in FIG. 1. The earthing contact 22 is arranged outside of that volume region of the tubular insulating body 20 in which the electrical contacts 21 are arranged. The earthing contact 22 has a pin-like front part 23 and a bulging region 24 which is radially thicker than the front part 23. The earthing contact 22 is formed to be bound to an appropriate conductive strand of an electrical cable in order to create an earthing connection or a protective earthing conductor connection. The electrical contacts 21 and the earthing contact 22 are arranged in the plug housing 2 in the mounted state.

The electrical plug 1, as shown in FIG. 1, has a separate and one-piece earthing connection element 25. The earthing connection element 25 is made of metal and is a prefabricated molded body which in the installed state is arranged in the plug housing 2 without alteration of shape. The earthing connection element 25 is formed in a single piece. The earthing connection element 25 forms an electrical earthing connection between the earthing contact 22, the first outer housing part 3, and the second housing part 4. The earthing connection element 25 is formed as a bending part, and in an embodiment, as a sheet-metal bending part. A molding blank or appropriate blank can be appropriately formed by several bending processes so that the molding according to FIG. 1 is produced before the earthing connection element 25 is installed in the plug housing 2.

The earthing connection element 25, as shown in FIG. 1, has an elongated base web 26 which is formed like a groove or channel. A groove opening 27 is oriented downwards here; the groove opening 27 faces the joining region 6 of the second outer housing part 4. The groove opening 27 also faces the joining flange 10.

The elongated base web 26, as shown in FIG. 1, has a longitudinal axis D. In the mounted state, the earthing contact 22 is received in the base web 26. In particular, the earthing contact 22 is retained in a clamping manner, or clamped, therein. The base web 26, in an embodiment, has a retaining tab 28 for this purpose that is formed by a slot or a free cut 29 in a groove wall of the base web 26. This tab 28 is formed at the front end of the base web 26. In the mounted state, the bulging region 24 is arranged in this region of the base web 26 in which the tab 28 is axially formed. The tab 28 encompasses the bulge 24 in a clamping manner. The base web 26 provides a high degree of mechanical stability, and an undesired deformation and twisting of the earthing connection element 25 can be avoided.

The earthing connection element 25, as shown in FIG. 1, has two wing elements 30 and 31. These wing elements 30, 31 are formed to be curved, in particular convexly curved and are thus, through their round-bodied configuration, in each case configured arching away from one another. The two wing elements 30 and 31 are formed integrally on the base web 26, in particular at an end of the base web 26 which is the rear end when viewed in the direction of the longitudinal axis D. The wing elements 30, 31 extend upwards from a respectively free edge of the groove shape of the base web 26 and are thus oriented facing away from the groove opening 27 in the opposite direction. The wing elements 30 and 31 form a further groove section which is open towards the top and is thus open facing the insulating body 20. The two wing elements 30 and 31, in their respective strip-shaped or plate-shaped configuration, are in particular also formed to be resilient, so that they also form a type of retaining clamp.

Figure 8:
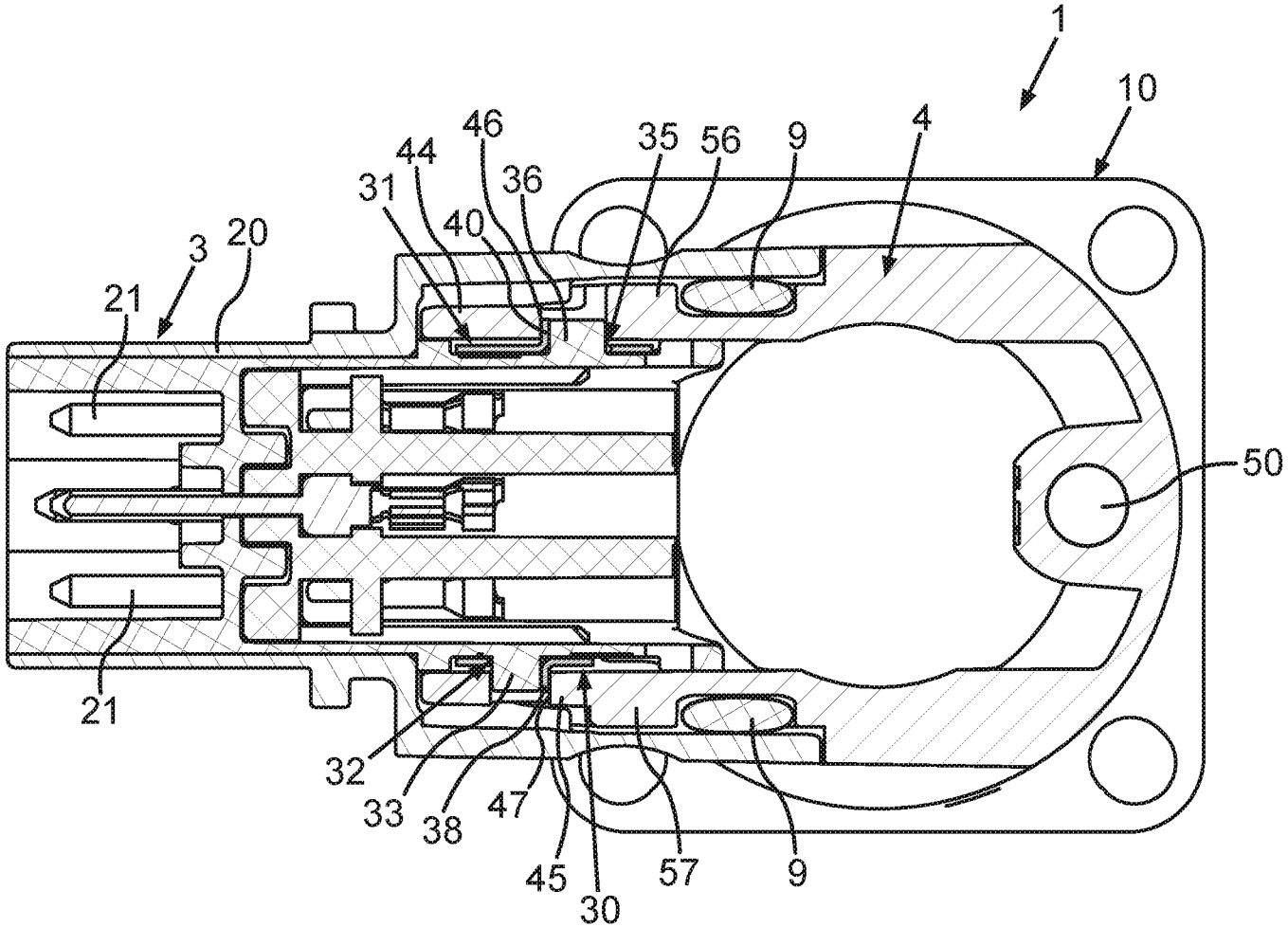
FIG. 8 is a sectional top view of the electrical plug, taken along line VIII-VIII of FIG. 2.

As shown in FIG. 1, the first wing element 30 has a first coupling hole 32, into which, in the mounted state, a first coupling pin 33 formed on a jacket wall 34 of the tubular insulating body 20, extends radially outwards. The second wing element 31 has a second coupling hole 35, in which, in the mounted state, there is arranged, extending radially outwards, a second coupling pin 36 which protrudes radially from the jacket wall 34, as shown in FIG. 8.

On a delimiting edge 37 which delimits the coupling hole 32, as shown in FIG. 1, a first contact tab 38 is molded and stands radially outwards viewed in the direction of the longitudinal axis D. Correspondingly, a second contact tab 40 which stands radially outwards relative to the longitudinal axis D is likewise molded on a delimiting edge 39 which delimits the coupling hole 35.

As shown in FIG. 1, at a free end of the first wing element 30 facing away from the base web 26, there is an axial contact tab 41 which is viewed in the direction of the longitudinal axis D and thus axially oriented. The axial contact tab 41, in the direction of the longitudinal axis D, extends further to the rear and thus further away from the first joining region 5 of the first outer housing part 3 than a strip-shaped base part 42 of the first wing element 30. The axial contact tab 41 also stands slightly outwards in the radial direction compared to the base part 42. The axial contact tab 41 is elastically deflectable with respect to the base part 42, in particular in a radial direction relative to the longitudinal axis D, and is biased outwards.

In the mounted state, shown in FIGS. 2-8, the earthing connection element 25 encompasses the jacket wall 34 with the wing elements 30 and 31 at least partly, and is fixed by clamping.

As shown in FIG. 1, the second outer housing part 4 has a groove-like section 43 on which the first outer housing part 3 is placed from above. On a front end of the section 43 facing the first outer housing part 3, protrusions are formed on opposite groove edges, with a second protrusion 44 being formed on a front edge and a first protrusion 45 being offset to the rear relative to the front edge. The protrusions 44, 45 are each formed by recesses or slots in the groove walls. As a result, a rear side 46 of the second protrusion 44 that faces away from the joining region 5 of the first outer housing part 3 is formed and, in the case of the first protrusion 45, a front side 47 facing the joining region 5 of the first outer housing part 3 is formed.

The first outer housing part 3, in particular protruding from the first abutting edge 7, as shown in FIG. 1, has a lug 48 which is formed at the end facing the second outer housing part 4. In the mounted state, the lug 48 engages a lug receptacle 49, in particular in a form-fitting manner. The lug receptacle 49 is formed in an upper region of the second outer housing part 4 and opens out by its lug receptacle entry into the abutting edge 8. With this lug connection device, the first outer housing part 3 is pressed onto the second outer housing part 4 and this pressing is then permanently maintained.

As shown in FIG. 1, a second screw hole 50 is formed in a rear end of the second outer housing part 4, which faces away from the first outer housing part 3, and an upper end of the second outer housing part 4, which faces away from the joining flange 10. A separate screw 51 which is guided through a first screw hole 52 in the first outer housing part 3 can be screwed into the second screw hole 50. A screw connection between the two outer housing parts 3 and 4 is formed through this configuration. The screw 51 is, in an embodiment, made of metal; as a result, a further protective earthing conductor connection is created between the outer housing parts 3 and 4.

Figure 3:
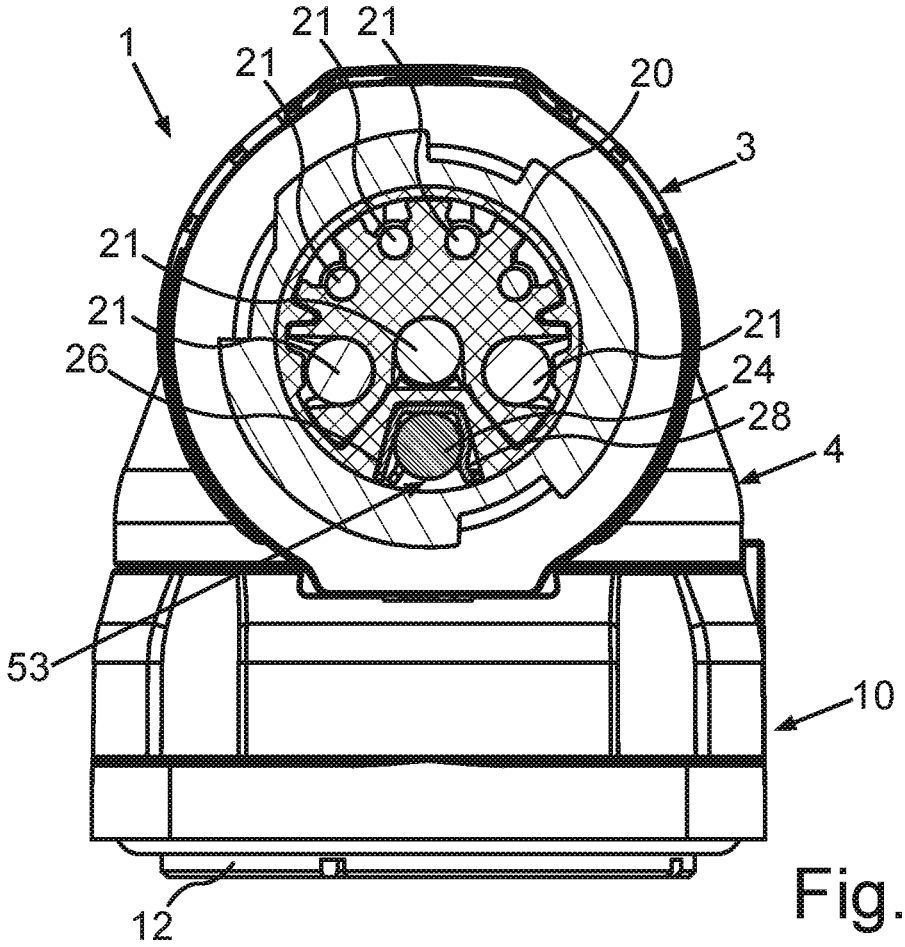
FIG. 3 is a sectional front view of the electrical plug, taken along line of FIG. 2.

As shown in FIG. 3, the insulating body 20 has, in the lower region and thus at a lower end facing the joining flange 10, a furrow 53 in which the base web 26 of the earthing connection element 25 is arranged in a fully inserted manner. The snug and clamped fitting of the bulge 24 of the earthing contact 22 can be recognized. The electrical contacts 21 and the number and position thereof should be understood only by way of example. In the shown embodiment, four electrical contacts 21 are arranged here in a ring section shape relative to one another and three electrical contacts 21, which in this sectional depiction have a larger cross-section, are arranged substantially in a line relative to one another.

Figure 4:
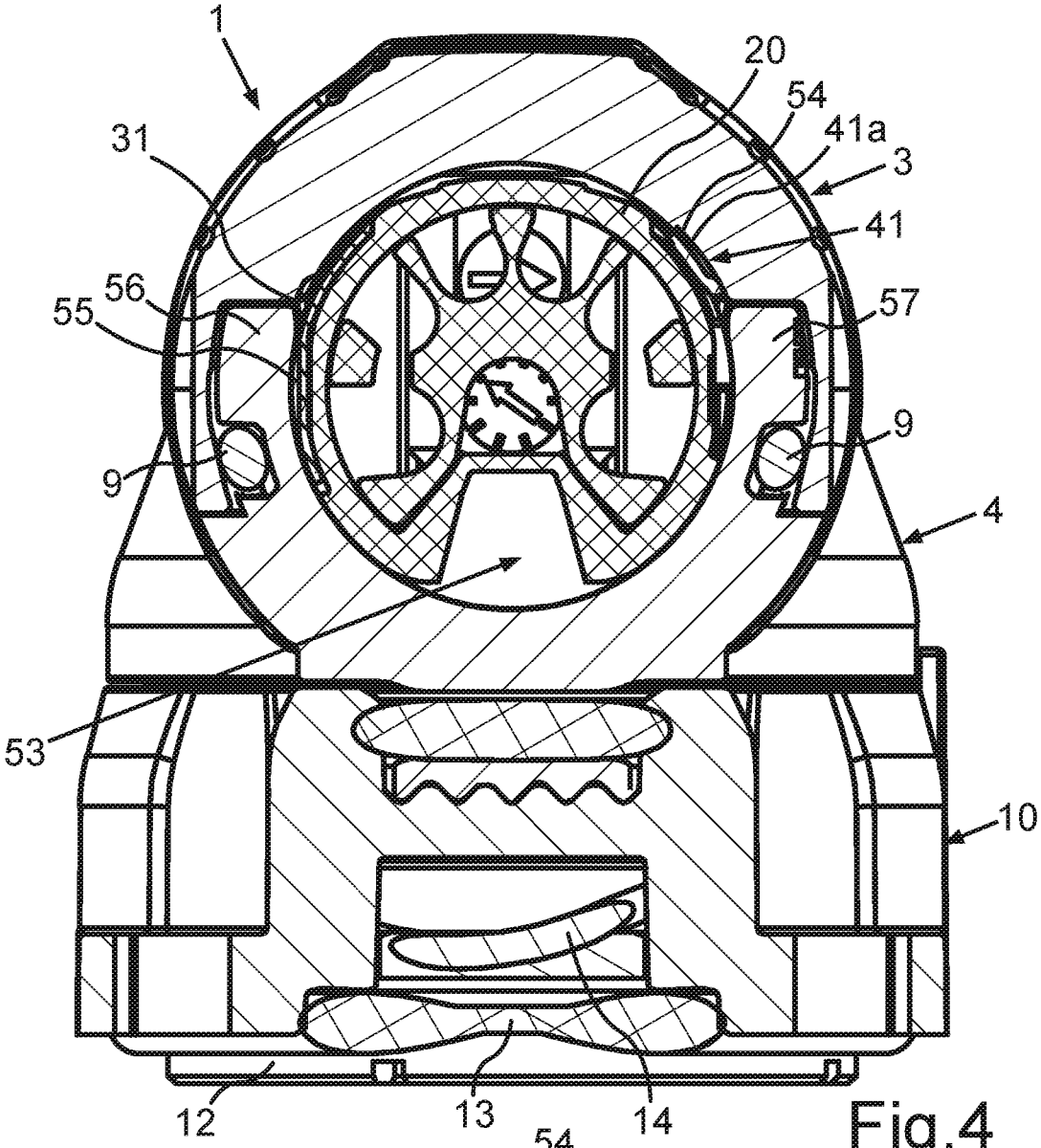
FIG. 4 is a sectional front view of the electrical plug, taken along line IV-IV of FIG. 2.

The section shown in FIG. 4 is positioned along the longitudinal axis D such that only the section through the axial contact tab 41 can be recognized on a first wing element 30 and the section through the second wing element 31 is behind the coupling hole 35 along the longitudinal axis D. The base web 26 does not extend so far to the rear along the longitudinal axis D, which means that there is no longer any such base web 26 present in the furrow 53 of the insulating body 20.

Figure 5:
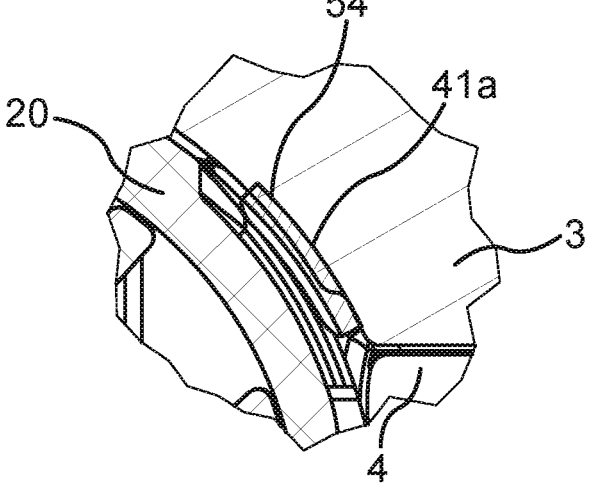
FIG. 5 is an enlarged portion of the sectional front view of FIG. 4.

As shown in FIG. 4, the axial contact tab 41 is arranged in a radial direction relative to a longitudinal axis of the insulating body 20, which extends parallel to the longitudinal axis A of the first outer housing part 3, abutting a metallic region of the first outer housing part 3. An outer surface 41*a* of the axial contact tab 41 is arranged here in a small depression 54 in an inner side of the first outer housing part 3. FIG. 5 shows the partly embedded state of the axial contact tab 41 in the depression 54. The second wing element 31 with an outer surface 55 is in direct electrical contact with the second outer housing part 4, in particular an inner side of the groove-shaped or trough-shaped configuration of the second outer housing part 4. A direct electrical contact to the first outer housing part 3 and the second outer housing part 4 is thus formed by the earthing connection element 25, in particular the two wing elements 30 and 31. The wing elements 30 and 31 directly abut the first outer housing part 3 and the second outer housing part 4. The groove wall sections 56 and 57 of the groove-shaped section of the second outer housing part 4 extend into receptacles formed by thinning of the wall of the first outer housing part 3. In another embodiment, at least one wing element 30, 31 is in direct electrical contact with both the first outer housing part 3 and the second outer housing part 4.

Figure 6:
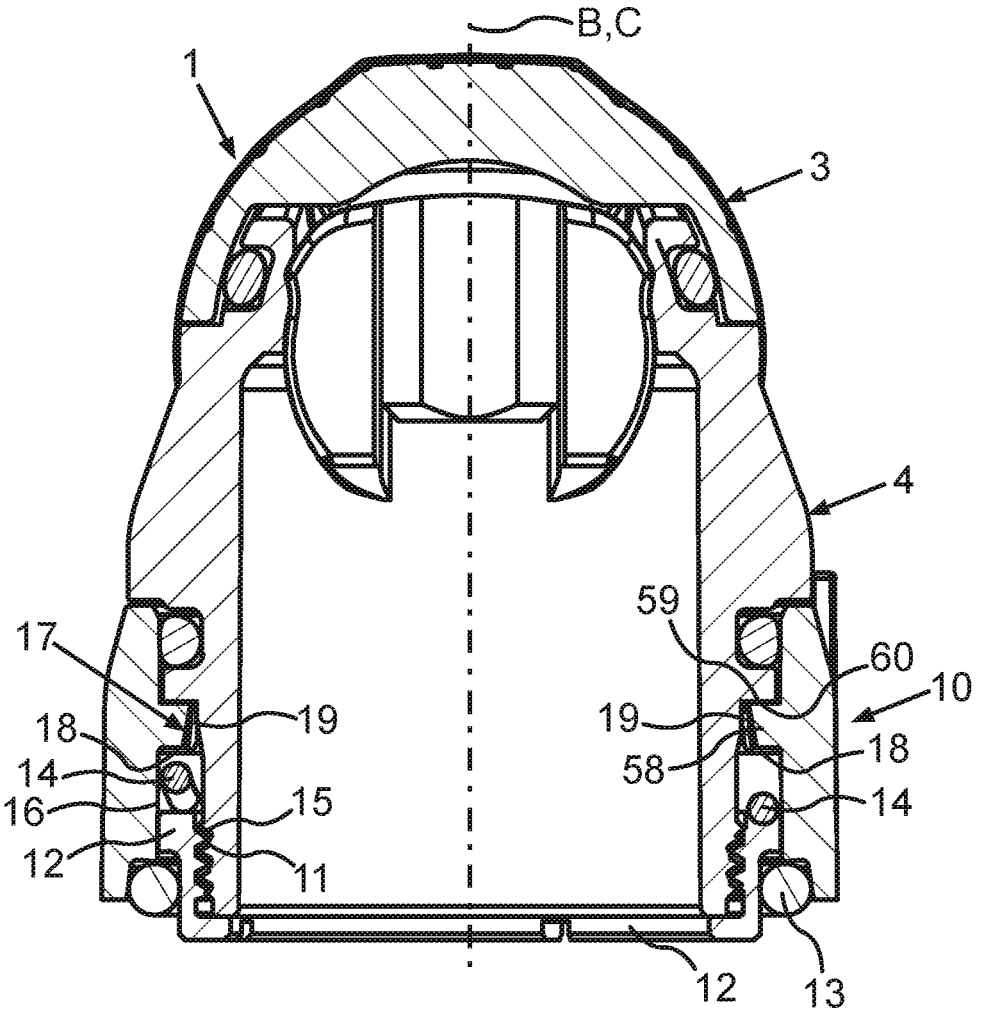
FIG. 6 is a sectional front view of the electrical plug, taken along line VI-VI of FIG. 2.

As shown in FIG. 6, the earthing connection element 25 does not extend so far to the rear; the earthing connection element 25 does not have an unnecessarily large size. The engagement of the first outer housing part 3 with the second outer housing part 4 and the engagement of the second outer housing part 4 with the joining flange 10 are shown in FIG. 6.

Figure 7:
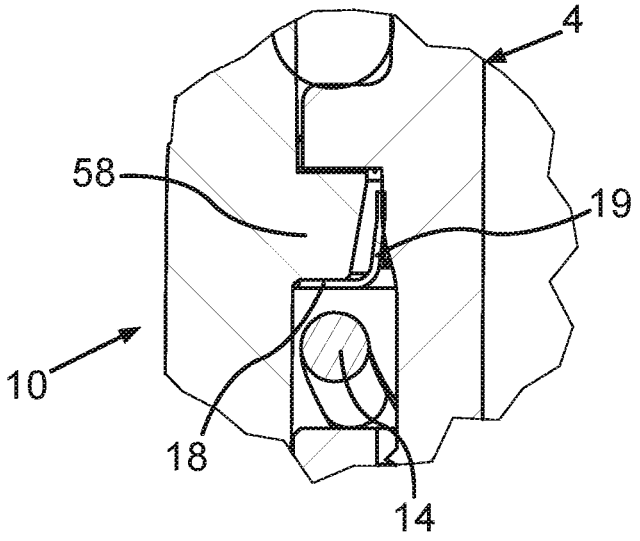
FIG. 7 is an enlarged portion of the sectional front view of FIG. 6.

As shown in FIGS. 6 and 7, the contact element 17 is in direct electrical connection with the joining flange 10 and the second outer housing part 4. The base ring 18 abuts an underside of a radial web 58 integrally formed on the inner side 16 of the joining flange 10. The teeth 19, which stand upwards and thus do not extend in the plane of the base ring 10, abut an outer side of the second outer housing part 4, as shown in FIGS. 6 and 7. As a result, a protective earthing conductor connection or an earthing connection is formed between the metallic joining flange 10 and the second outer housing part 4, which is also metallic. A coupling toothing 59 formed at the second outer housing part 4 meshes with a mating coupling toothing 60 formed at the upper side of the radial web 58 at the joining flange 10. As a result, in the circumferential direction around axes B and C, various relative and discrete rotational positions can be set between the second outer housing part 4 and the joining flange 10. For the purposes of clarity, the reference numbers 59, 60 are only depicted on one side in FIG. 6, however, the coupling toothing 59 and the mating coupling toothing 60 are formed as circumferential closed rings.

As shown in FIG. 8, the radial contact tab 40 of the second wing element 31 abuts the rear side 46 of the protrusion 44.

The coupling pin 36 abuts the radial contact tab 40, at the opposite side to the rear side 46. The recess or free cut or slot formed in the groove wall is thus snugly filled by the radial contact tab 40 and the coupling pin 36 in the axial direction. The first contact tab 38 of the first wing element 30 abuts the front side 47 of the first protrusion 45. The first coupling pin 33 extends into this recess of the groove wall, so that here too there is a snug introduction of the coupling pin 33 and the first contact tab 38 in the axial direction. The first contact tab 38 is clamped between the front side 47 and the coupling pin 33 and is mechanically contacted on both sides.

In the electrical plug 1 with the at least three separate outer parts, the first outer housing part 3, the second outer housing part 4, and the joining flange 10, in each case there are formed individual earthing connection points, so that an earthing connection chain is formed with these earthing connection points. The entire earthing connection chain is formed such that a transition resistance smaller than 20 mΩ is formed at all points.

What is claimed is:

1. An electrical plug, comprising:

a plug housing having a first outer housing part and a second outer housing part separate from the first outer housing part, the first outer housing part and the second outer housing part are each at least partly metallic;

an earthing contact disposed in the plug housing; and an earthing connection element separate from and electrically connected to the earthing contact and disposed in the plug housing, the earthing connection element has an elongated base web defining a groove extending in a longitudinal direction of the base web and receiving the earthing contact and a pair of wing elements extending from opposite sides of the base web relative to a longitudinal axis of the base web, wherein at least one of the wing elements electrically contacts the first outer housing part to form an earthing connection, and at least one of the wing elements electrically contacts the second outer housing part to form an earthing connection.

2. The electrical plug of claim 1, wherein the earthing connection element is formed in a single piece as a molded and bent part.

3. The electrical plug of claim 1, wherein a groove opening of the base web is oriented downwards.

4. The electrical plug of claim 1, wherein a first wing element of the pair of wing elements has an axially protruding contact tab electrical contact with the first outer housing part.

5. The electrical plug of claim 4, wherein a second wing element of the pair of wing elements has an outer surface in electrical contact with the second outer housing part.

6. The electrical plug of claim 1, wherein at least one of the wing elements has a radially protruding contact tab in electrical contact with the second outer housing part.

7. The electrical plug of claim 1, further comprising a tubular insulating body, at least one of the wing elements has a coupling hole receiving a coupling pin of the tubular insulating body.

8. The electrical plug of claim 7, wherein a first wing element of the pair of wing elements has a radially protruding first contact tab at a delimiting edge of a first coupling hole of the first wing element, the radially protruding first contact tab abuts a front side of a first protrusion of the second outer housing part and is axially clamped between a first coupling pin of the tubular insulating body and the front side.

9. The electrical plug of claim 8, wherein a second wing element of the pair of wing elements has a radially protruding second contact tab at a delimiting edge of a second coupling hole of the second wing element, the radially protruding second contact tab abuts a rear side of a second protrusion of the second outer housing part and is axially clamped between a second coupling pin of the insulating body and the rear side.

10. The electrical plug of claim 1, further comprising an insulating body having a tubular shape and in which a plurality of electrical contacts are received, the insulating body is arranged in the plug housing.

11. The electrical plug of claim 10, wherein the earthing connection element is arranged on an outside of the insulating body and is retained on the insulating body in a clamping manner.

12. The electrical plug of claim 11, wherein the insulating body has a downwardly open furrow receiving a base web of the earthing connecting element.

13. The electrical plug of claim 1, further comprising a joining flange separate from the first outer housing part and the second outer housing part and connected to the second outer housing part, the joining flange is at least partly metallic.

14. The electrical plug of claim 13, further comprising a metallic contact element disposed between the second outer housing part and the joining flange, the metallic contact element is a segmented contact ring electrically connected to the second outer housing part and the joining flange.

15. The electrical plug of claim 14, wherein an earthing connection between the first outer housing part, the second outer housing part, and the joining flange has a transition resistance less than 100 mΩ at each of a plurality of earthing connection points of the earthing connection.

16. The electrical plug of claim 1, wherein the first outer housing part has a lug engaging a lug receptacle of the second outer housing part.

17. The electrical plug of claim 1, wherein a longitudinal axis of a first joining region of the first outer housing part is oriented at an angle of between 60° and 120° to a longitudinal axis of a second joining region of the second outer housing part.

18. An electrical plug, comprising:

a plug housing having a first outer housing part and a second outer housing part separate from the first outer housing part, the first outer housing part and the second outer housing part each define an outwardly exposed exterior of the plug housing and are each at least partly metallic;

an earthing contact disposed in the plug housing; and an earthing connection element separate from and electrically connected to the earthing contact and disposed in the plug housing, the earthing connection element having a base and at least one wing element extending from the base, wherein the at least one wing element directly electrically contacts each of the first outer housing part to form an earthing connection, and the at least one wing element directly electrically contacts the second outer housing part to form an earthing connection.

19. An electrical plug, comprising:

a plug housing having a first outer housing part and a second outer housing part separate from the first outer housing part, the first outer housing part and the second outer housing part each define an outwardly exposed exterior of the plug housing and are each at least partly metallic;

an earthing contact disposed in the plug housing; and an earthing connection element separate from the earthing contact and disposed in the plug housing, the earthing connection element directly contacts and is electrically connected to each of the earthing contact, the first outer housing part, and the second outer housing part.

20. The electrical plug of claim 19, wherein:

the first outer housing includes a first end and a second end opposite the first end; and the second outer housing includes a first end joined to the first end of the first outer housing and a second end arranged opposite the first end of the second outer housing in a direction away from the second end of the first outer housing.

* * * * *